US010302040B2

(12) United States Patent
Nakayama et al.

(10) Patent No.: US 10,302,040 B2
(45) Date of Patent: May 28, 2019

(54) CYLINDER HEAD FOR INTERNAL COMBUSTION ENGINE

(71) Applicant: TOYOTA JIDOSHA KABUSHIKI KAISHA, Toyota-shi (JP)

(72) Inventors: Masao Nakayama, Nagoya (JP); Masahiko Asano, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/921,895

(22) Filed: Mar. 15, 2018

(65) Prior Publication Data

US 2018/0274477 A1 Sep. 27, 2018

(30) Foreign Application Priority Data

Mar. 21, 2017 (JP) ..... 2017-055067

(51) Int. Cl.

| | |
|---|---|
| ***F02F 1/40*** | (2006.01) |
| ***F02F 1/42*** | (2006.01) |
| ***F01P 3/02*** | (2006.01) |
| *F02F 1/24* | (2006.01) |

(52) U.S. Cl.

CPC ..... *F02F 1/40* (2013.01); *F01P 3/02* (2013.01); *F02F 1/4285* (2013.01); *F01P 2003/024* (2013.01); *F02F 1/242* (2013.01)

(58) Field of Classification Search

CPC ..... F02F 1/40; F02F 1/4285; F02F 1/242; F01P 3/02; F01P 2003/024

See application file for complete search history.

(56) References Cited

U.S. PATENT DOCUMENTS

2005/0145204 A1* 7/2005 Iida ..... F01P 3/16 123/41.31

FOREIGN PATENT DOCUMENTS

DE 19961092 A1 * 7/2000 ..... B22D 19/0009
JP 2001-207844 8/2001

* cited by examiner

*Primary Examiner* — Hung Q Nguyen
(74) *Attorney, Agent, or Firm* — Oblon, McClelland, Maier & Neustadt, L.L.P.

(57) ABSTRACT

A cylinder head in an internal combustion engine includes a cylinder head main body in which a plurality of combustion chambers is arranged and a pipe member that extends along a direction in which the combustion chambers are arranged, through which a refrigerant flows, and which is embedded in the cylinder head main body. The pipe member is provided with a curved portion that is curved and the curved portion is provided with a throttle region in which a sectional area is partially reduced.

8 Claims, 6 Drawing Sheets

CYLINDER HEAD FOR INTERNAL COMBUSTION ENGINE

INCORPORATION BY REFERENCE

The disclosure of Japanese Patent Application No. 2017-055067 filed on Mar. 21, 2017 including the specification, drawings and abstract is incorporated herein by reference in its entirety.

BACKGROUND

1. Technical Field

The present disclosure relates to a cylinder head for an internal combustion engine.

2. Description of Related Art

A cylinder head is known, in which a water jacket formed by a pipe member is embedded in order to suppress a temperature rise in a combustion chamber provided in the cylinder head for an internal combustion engine. The pipe member extends along a plurality of combustion chambers arranged in the cylinder head and is provided with a curved portion that is partially curved in order to avoid interference with an exhaust port or an ignition plug (for example, refer to Japanese Unexamined Patent Application Publication No. 2001-207844 (JP 2001-207844 A)).

SUMMARY

In the curved portion, there may be a decrease in flow rate due to an increase in refrigerant pressure drop. Therefore, there is a possibility that the combustion chambers cannot be effectively cooled and the temperatures of the combustion chambers become high.

The disclosure provides a cylinder head for an internal combustion engine in which a temperature rise in a combustion chamber is more effectively suppressed.

An aspect of the disclosure relates to a cylinder head for an internal combustion engine. The cylinder head includes a cylinder head main body and pipe members. In the cylinder head main body, a plurality of combustion chambers is arranged. The pipe member extends along a direction in which the combustion chambers are arranged, a refrigerant flows through the pipe member, and the pipe member is embedded in the cylinder head main body. The pipe member is provided with a first curved portion that is curved and the first curved portion is provided with a first throttle region. A sectional area of the first throttle region is partially reduced.

According to the aspect of the disclosure, since the first throttle region is provided in the first curved portion, a decrease in flow rate in the first curved portion is suppressed and a temperature rise in the first combustion chamber is suppressed.

In the cylinder head according to the aspect of the disclosure, the combustion chamber may include a first combustion chamber which is closest to the first curved portion. The first curved portion may be curved to be close to the first combustion chamber.

In the cylinder head according to the aspect of the disclosure, a first wall portion of the first curved portion may be provided with a first thin portion, which faces the first combustion chamber, and which is thinner than another portion.

In the cylinder head according to the aspect of the disclosure, at least a portion of the first thin portion may be provided in the first throttle region.

In the cylinder head according to the aspect of the disclosure, the combustion chambers may further include a second combustion chamber that is adjacent to the first combustion chamber and that is downstream or upstream of the first combustion chamber in a flowing direction of the refrigerant, the pipe member is further provided with a second curved portion that is closest to the second combustion chamber, the second curved portion is provided with a second throttle region, and a path sectional area at the second throttle region is smaller than a path sectional area at the first throttle region.

In the cylinder head according to the aspect of the disclosure, the combustion chambers may further include a second combustion chamber that is adjacent to the first combustion chamber and that is downstream or upstream of the first combustion chamber in a flowing direction of the refrigerant, the pipe member is further provided with a second curved portion that is closest to the second combustion chambers, a second wall portion of the second curved portion is provided with a second thin portion which is thinner than the first thin portion.

In the cylinder head according to the aspect of the disclosure, the first curved portion may be positioned between two exhaust ports that communicate with the first combustion chamber, and the second curved portion may be positioned between two exhaust ports that communicate with the second combustion chamber.

In the cylinder head according to the aspect of the disclosure, the first curved portion may be positioned between two intake ports that communicate with the first combustion chamber, and the second curved portion may be positioned between two intake ports that communicate with the second combustion chamber.

In the cylinder head according to the aspect of the disclosure, the pipe members may include a first pipe member and a second pipe member that are disposed such that an ignition plug is interposed between the first pipe member and the second pipe member in a top view.

According to the aspect of the disclosure, it is possible to provide a cylinder head for an internal combustion engine in which a temperature rise in a combustion chamber is suppressed.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
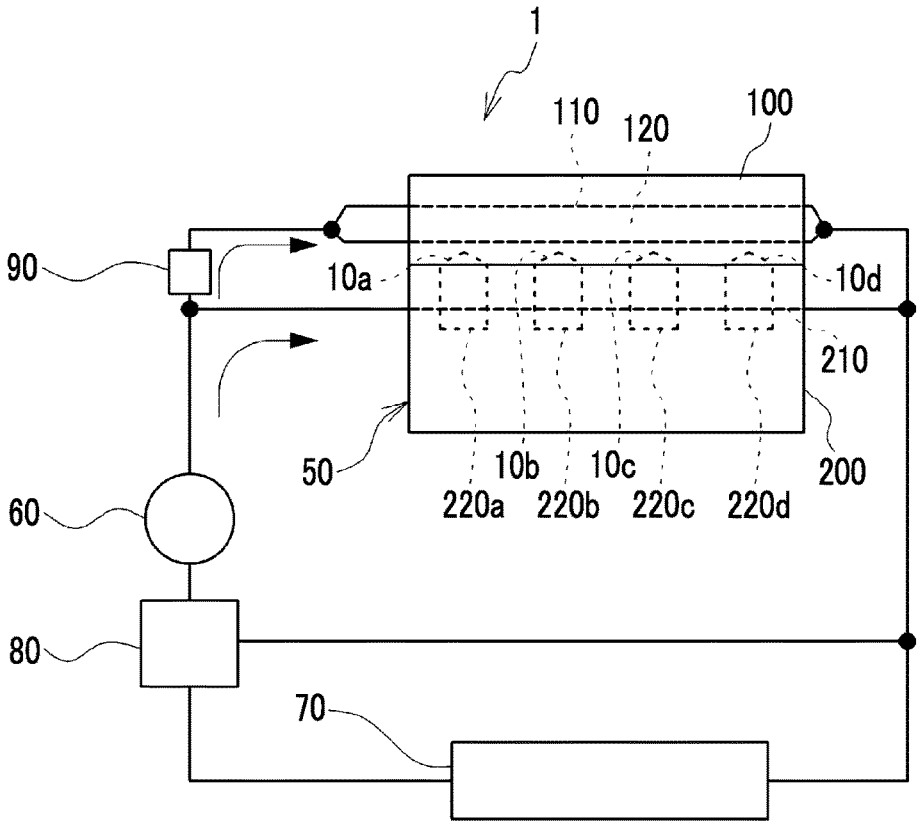
FIG. 1 is an explanatory view of a refrigerant flow path in an engine system.

FIG. 1 is an explanatory view of a refrigerant flow path in an engine system 1. The engine system 1 is provided with an engine 50, a water pump 60, a radiator 70, a thermostat 80, and a flow control valve 90. The engine 50 is provided with a cylinder block 200 and a cylinder head 100 that is disposed above the cylinder block 200. In the cylinder block 200, cylinders 220*a* to 220*d* arranged in one direction are formed. In the cylinder head 100, combustion chambers 10*a* to 10*d* that respectively correspond to the cylinders 220*a* to 220*d* are formed. In each of the cylinders 220*a* to 220*d*, a piston (not shown) is accommodated such that the piston can reciprocate. In the cylinder block 200, a water jacket 210 extending around the cylinders 220*a* to 220*d* is formed. In the cylinder head 100, pipe members 110, 120 are embedded.

A refrigerant is split according to the opening degree of the flow control valve 90 after being discharged from the water pump 60 and a portion of the refrigerant flows through the pipe members 110, 120 of the cylinder head 100 and the remainder of the refrigerant flows through the water jacket 210 of the cylinder block 200. Refrigerants discharged from the cylinder head 100 and the cylinder block 200 join each other and return to the water pump 60 via the thermostat 80 or return to the water pump 60 via the radiator 70 and the thermostat 80. The engine 50 is cooled when the refrigerant flows through the pipe members 110, 120 or the water jacket 210.

Figure 2:
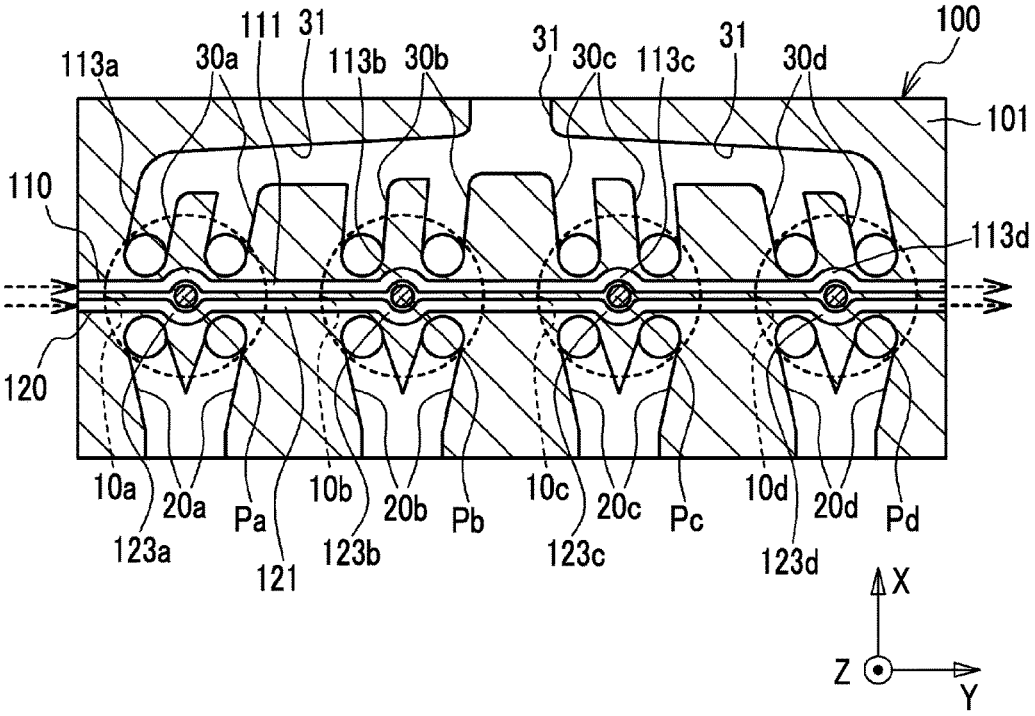
FIG. 2 is a sectional view of a cylinder head.

Next, the cylinder head 100 will be described. FIG. 2 is a sectional view of the cylinder head 100. FIG. 2 illustrates a section that is orthogonal to an axial direction of each of the cylinders 220*a* to 220*d* that define the combustion chambers 10*a* to 10*d*. In other words, FIG. 2 illustrates a section that is orthogonal to a reciprocating direction of the piston. In FIG. 2, a Y-axis direction is a direction in which the combustion chambers 10*a* to 10*d* are arranged and an X-axis direction is a direction from intake ports 20*a* to 20*d* to exhaust ports 30*a* to 30*d*. The X-axis direction and the Y-axis direction correspond to a horizontal direction and a Z-axis direction corresponds to a vertical direction. The section in FIG. 2 is a section as seen from a vertically upper side. Accordingly, the combustion chambers 10*a* to 10*d* are positioned closer to the back side of the paper surface than the section in FIG. 2.

The cylinder head 100 includes a cylinder head main body 101 that is an aluminum alloy casting and the pipe members 110, 120 that are embedded in the cylinder head main body 101. The combustion chambers 10*a* to 10*d*, the intake ports 20*a* to 20*d*, the exhaust ports 30*a* to 30*d*, and an exhaust manifold 31 are formed in the cylinder head main body 101. Ignition plugs Pa to Pd are disposed at the respective central positions in the combustion chambers 10*a* to 10*d*. The exhaust ports 30*a* to 30*d* respectively communicate with the combustion chambers 10*a* to 10*d*. The exhaust manifold 31 communicates with the exhaust ports 30*a* to 30*d*. The number of each of the exhaust ports 30*a* to 30*d* is two and the exhaust ports 30*a* to 30*d* are opened and closed by an exhaust valve (not shown). The intake ports 20*a* to 20*d* respectively communicate with the combustion chambers 10*a* to 10*d*. The number of each of the intake ports 20*a* to 20*d* is two and the intake ports 20*a* to 20*d* are opened and closed by an intake valve (not shown).

Each of the pipe members 110, 120 is a pipe formed of an aluminum alloy and the pipe members 110, 120 extend along each other in a direction in which the combustion chambers 10*a* to 10*d* are arranged. A flowing direction in which the refrigerant flows in the pipe member 110 and a flowing direction in which the refrigerant flows in the pipe member 120 are the same as each other. The shape of a section of each of the pipe members 110, 120 is an approximately perfect circle-like shape. However, the invention is not limited to this and the shape of the section may be an oval shape. The pipe member 110 is disposed between the ignition plugs Pa to Pd and the exhaust ports 30*a* to 30*d*. The pipe member 120 is disposed between the ignition plugs Pa to Pd and the intake ports 20*a* to 20*d*. The pipe members 110, 120 are positioned vertically above the combustion chambers 10*a* to 10*d* and the combustion chambers 10*a* to 10*d* are cooled by the refrigerants flowing in the pipe members 110, 120.

Specifically, the pipe member 110 is provided with an approximately linearly extending main body portion 111, and curved portions 113*a* to 113*d* that are partially formed on the main body portion 111. The curved portion 113*a* protrudes between the two exhaust ports 30*a* and is curved to avoid the ignition plug Pa. The same applies to the curved portions 113*b* to 113*d*, the exhaust ports 30*b* to 30*d*, and the ignition plugs Pb to Pd. Therefore, when the refrigerant flows through the pipe member 110, a temperature rise in the vicinity of the exhaust ports 30*a* to 30*d* and the ignition plugs Pa to Pd is further suppressed.

The pipe member 120 is provided with an approximately linearly extending main body portion 121, and curved portions 123*a* to 123*d* that are partially formed on the main body portion 121. The curved portion 123*a* protrudes between the two intake ports 20*a* and is curved to avoid the ignition plug Pa. The same applies to the curved portions 123*b* to 123*d*, the intake ports 20*b* to 20*d*, and the ignition plugs Pb to Pd. Therefore, when the refrigerant flows through the pipe member 120, a temperature rise in the vicinity of the intake ports 20*a* to 20*d* and the ignition plugs Pa to Pd is further suppressed.

The intake ports 20*a* and the exhaust ports 30*a* communicate with the combustion chamber 10*a*. Similarly, the intake ports 20*b* to 20*d* and the exhaust ports 30*b* to 30*d* respectively communicate with the combustion chambers 10*b* to 10*d*. Therefore, a temperature rise in the combustion chambers 10*a* to 10*d* is also suppressed as with the intake ports 20*a* to 20*d* and the exhaust ports 30*a* to 30*d*. Furthermore, as described above, the pipe members 110, 120 are disposed such that the ignition plugs Pa to Pd are interposed between the pipe members 110, 120. Therefore, a temperature rise in the vicinity of the ignition plugs Pa to Pd is further suppressed.

Next, the curved portions 113*a* to 113*d* of the pipe member 110 will be described in detail. FIG. 3A, FIG. 3B, FIG. 4A, and FIG. 4B are respectively sectional views illustrating the vicinity of the curved portions 113*a* to 113*d*. FIGS. 3A to 4B illustrate sections orthogonal to the X-axis direction. The lower side in each of FIGS. 3A to 4B is a vertically lower side and is a side on which the cylinder block 200 is disposed. As illustrated in FIGS. 3A to 4B, the curved portions 113*a* to 113*d* are curved to protrude toward the vertically lower side. As illustrated in FIG. 2, the curved portions 113*a* to 113*d* are also curved in the horizontal direction. Therefore, the curved portions 113*a* to 113*d* are curved in the horizontal direction and are curved toward the vertically lower side.

Figure 3A:
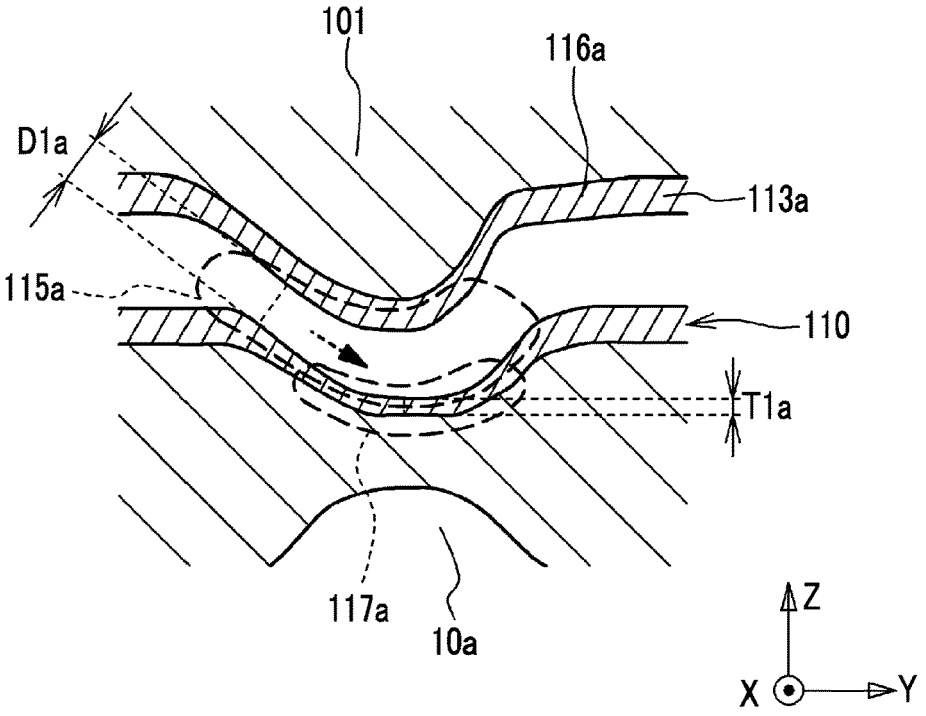
FIG. 3A is a sectional view illustrating the vicinity of a curved portion.

As illustrated in FIG. 3A, the curved portion 113*a* is curved toward the vertically lower side such that the curved portion 113*a* becomes closer to the combustion chamber 10*a* that is closest to the curved portion 113*a* among the combustion chambers 10*a* to 10*d*. With the refrigerant flowing through the curved portion 113*a* that is curved to become close to the combustion chamber 10*a* as described above, it is possible to suppress a temperature rise in the combustion chamber 10*a*.

In the curved portion 113*a*, a throttle region 115*a* having a smaller path sectional area than that of another portion is formed over a predetermined area. The throttle region 115*a* is provided in the curved portion 113*a*. Specifically, in the throttle region 115*a*, the path sectional area gradually decreases from an upstream side, the path sectional area becomes approximately constant after the decrease, and the path sectional area gradually increases to reach the original path sectional area at a downstream side. The decrease and the increase in path sectional area are realized by a decrease and an increase in inner diameter. The shape of the section at the throttle region 115*a* is maintained at the approximately perfect circle-like shape. However, the invention is not limited to this and the shape of the section at the throttle region 115*a* may be maintained at an approximately circular shape including an oval shape or a perfect circle-like shape. Accordingly, the resistance to the refrigerant is suppressed. The shape of the section at the curved portion 113*a* other than the throttle region 115*a* or the main body portion 111 is also maintained at an approximately circular shape including an oval shape or a perfect circle-like shape. The throttle region 115*a* may have a shape such that the path sectional area of the throttle region 115*a* is minimized at an intermediate position between the upstream side and the downstream side, the path sectional area gradually decreases from the upstream side toward the intermediate position, and the path sectional area gradually increases from the intermediate position to the downstream side.

Since the path sectional area is partially reduced, the flow rate of a fluid increases at a portion with a reduced path sectional area in comparison with a case where the path sectional area is constant at all times. Therefore, a decrease in flow rate of the refrigerant flowing through the curved portion 113*a* provided with the throttle region 115*a* is suppressed in comparison with a case where the throttle region 115*a* is not provided. Therefore, a temperature rise in the combustion chamber 10*a* is more effectively suppressed. In FIG. 3A, a diameter D1*a* at the throttle region 115*a* is illustrated.

A wall portion of the curved portion 113*a* is provided with a thick portion 116*a* and a thin portion 117*a* that is formed to be thinner than the thick portion 116*a*. The thin portion 117*a* is formed at a position facing the combustion chamber 10*a*. Therefore, transmission of heat from the combustion chamber 10*a* to the refrigerant is promoted via the thin portion 117*a* and a temperature rise in the combustion chamber 10*a* is more effectively suppressed with the refrigerant flowing along the thin portion 117*a*.

At least a portion of the thin portion 117*a* is formed in the throttle region 115*a*. Therefore, since the refrigerant of which a decrease in flow rate is suppressed flows along the thin portion 117*a*, it is possible to more effectively suppress a temperature rise in the combustion chamber 10*a*.

Figure 3B:
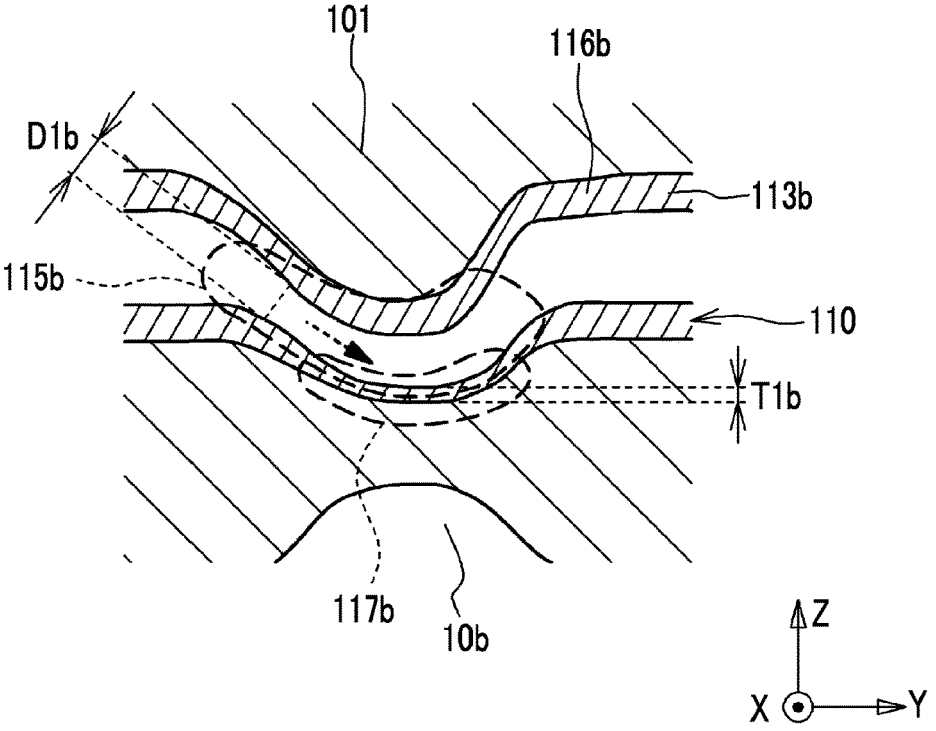
FIG. 3B is a sectional view illustrating the vicinity of a curved portion.
Figure 4A:
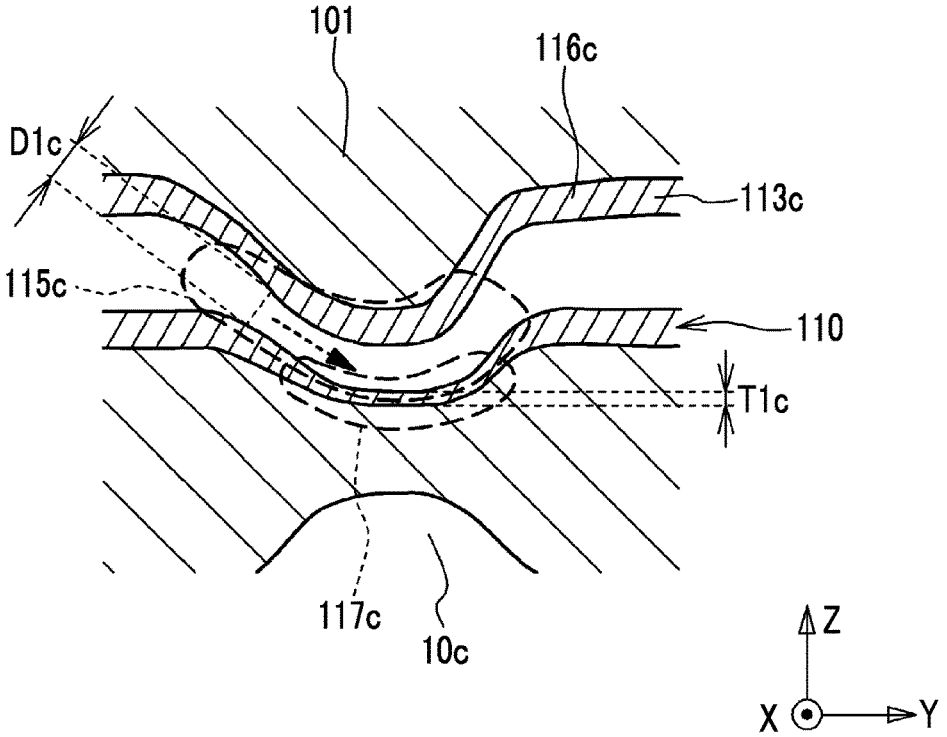
FIG. 4A is a sectional view illustrating the vicinity of a curved portion.
Figure 4B:
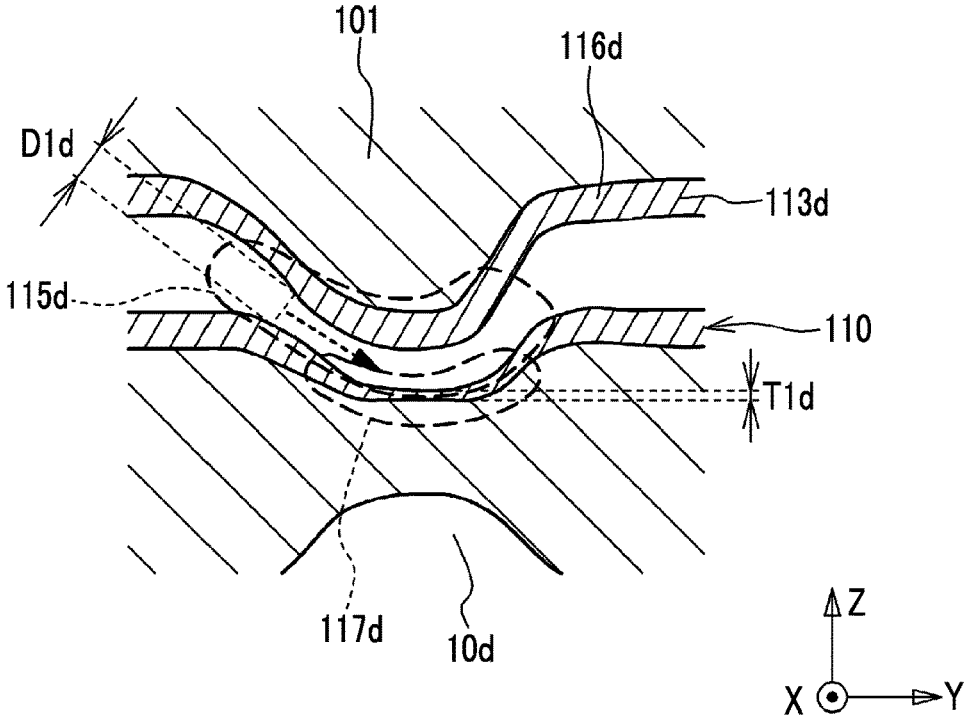
FIG. 4B is a sectional view illustrating the vicinity of a curved portion.

Similarly, as illustrated in FIGS. 3B, 4A, and 4B, the curved portions 113*b* to 113*d* are respectively provided with throttle regions 115*b* to 115*d*, thick portions 116*b* to 116*d*, and thin portions 117*b* to 117*d* and a temperature rise in the combustion chambers 10*b* to 10*d* is more effectively suppressed. The throttle regions 115*a* to 115*d* are respectively formed in the curved portions 113*a* to 113*d* and a decrease in flow rate of the refrigerant is suppressed. Accordingly, a decrease in flow rate of the refrigerant in the entire pipe member 110 is also suppressed and a temperature rise in the entire combustion chambers 10*a* to 10*d* is more effectively suppressed.

The respective diameters D1*a* to D1*d* of the throttle regions 115*a* to 115*d* descend in this order: the diameter D1*a*, the diameter D1*b*, the diameter D1*c*, and the diameter D1*d*. Therefore, the flow rates of the refrigerants flowing in the throttle regions 115*a* to 115*d* ascend in this order: the throttle region 115*a*, the throttle region 115*b*, the throttle region 115*c*, and the throttle region 115*d*. As described above, the flow rate of the refrigerant flowing on the downstream side in the curved portion is higher than that of the refrigerant flowing on the upstream side in the curved portion.

Since the refrigerant receives heat from each combustion chamber when flowing from the upstream side to the downstream side, the temperature of the refrigerant increases toward the downstream side. Therefore, in a case where the flow rates of refrigerants respectively flowing in the curved portions 113*a* to 113*d* are the same as each other, the cooling efficiency of the refrigerant decreases toward the downstream side and the temperature ascends in this order: the combustion chamber 10*a*, the combustion chamber 10*b*, the combustion chamber 10*c*, and the combustion chamber 10*d*. Therefore, there is a possibility that the temperature in the combustion chambers 10*a* to 10*d* varies. In this embodiment, the variation in temperature in the combustion chambers 10*a* to 10*d* is suppressed since the flow rates of the refrigerants flowing in the throttle regions 115*a* to 115*d* ascend in this order: the throttle region 115*a*, the throttle region 115*b*, the throttle region 115*c*, and the throttle region 115*d*.

The respective thicknesses T1*a* to T1*d* of the thin portions 117*a* to 117*d* descend in this order: the thickness T1*a*, the thickness T1*b*, the thickness T1*c*, and the thickness T1*d*. The variation in temperature in the combustion chambers 10*a* to 10*d* is also suppressed due to the above-described point.

As described above, since the variation in temperature in the combustion chambers 10*a* to 10*d* is suppressed, it is possible to effectively suppress a possibility of knocking or the like in a combustion chamber with a relatively high temperature.

Although the thin portions 117*a* to 117*d* are thin, a decrease in strength of the pipe member 110 is suppressed since the thick portions 116*a* to 116*d* are thick.

Next, the curved portions 123*a* to 123*d* of the pipe member 120 will be described. Since the curved portions 123*a* to 123*d* have similar configurations as those of the curved portions 113*a* to 113*d*, the description will be simplified. FIG. 5A, FIG. 5B, FIG. 6A, and FIG. 6B are respectively sectional views illustrating the vicinity of the curved portions 123*a* to 123*d*. FIGS. 5A to 6B illustrate sections orthogonal to the X-axis direction. The lower side in each of FIGS. 5A to 6B is the vertically lower side and is the side on which the cylinder block 200 is disposed. As illustrated in FIGS. 5A to 6B, and FIG. 2, the curved portions 123*a* to 123*d* are curved in the horizontal direction and are curved toward the vertically lower side.

Figure 5A:
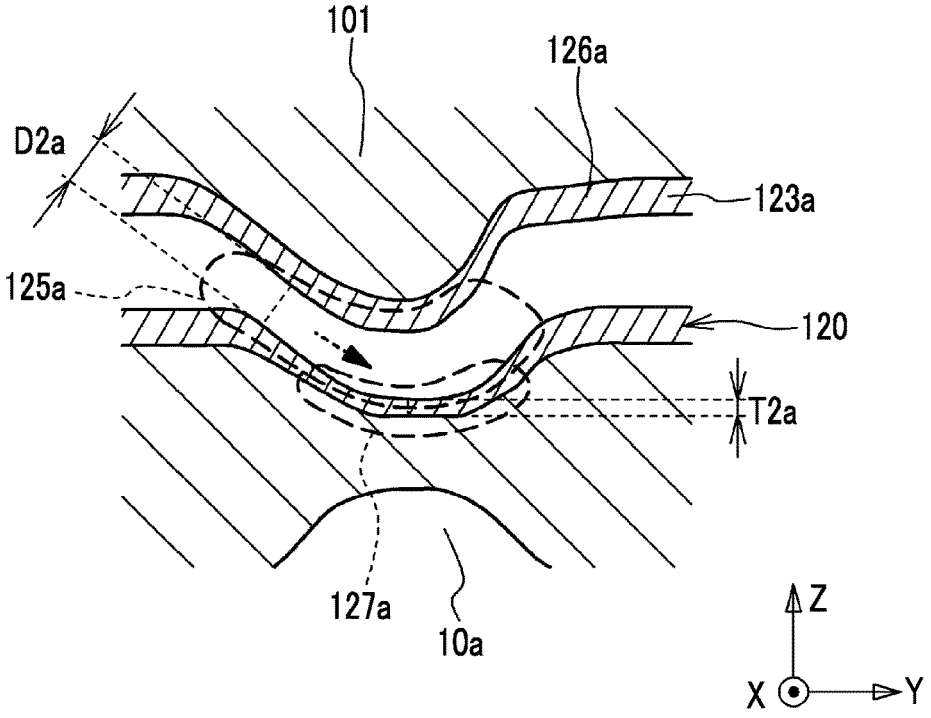
FIG. 5A is a sectional view illustrating the vicinity of a curved portion.

As illustrated in FIG. 5A, since the curved portion 123*a* is curved toward the vertically lower side such that the curved portion 123*a* becomes closer to the combustion chamber 10*a* that is closest to the curved portion 123*a* among the combustion chambers 10*a* to 10*d*, a temperature rise in the combustion chamber 10*a* is more effectively suppressed with the refrigerant flowing through the curved portion 123*a*. In addition, in the curved portion 123*a*, a throttle region 125*a* having a smaller path sectional area than that of another portion is formed over a predetermined area. Accordingly, a decrease in flow rate of the refrigerant is suppressed, and thus a temperature rise in the combustion chamber 10*a* is more effectively suppressed. In FIG. 5A, a diameter D2*a* at the throttle region 125*a* is illustrated.

A wall portion of the curved portion 123*a* is provided with a thick portion 126*a* and a thin portion 127*a* that is formed to be thinner than the thick portion 126*a* and the thin portion 127*a* faces the combustion chamber 10*a*. Therefore, a temperature rise in the combustion chamber 10*a* is more effectively suppressed with the refrigerant flowing along the thin portion 127*a*. At least a portion of the thin portion 127*a* is formed in the throttle region 125*a*. Therefore, since the refrigerant of which a decrease in flow rate is suppressed flows along the thin portion 127*a*, a temperature rise in the combustion chamber 10*a* is more effectively suppressed.

Figure 5B:
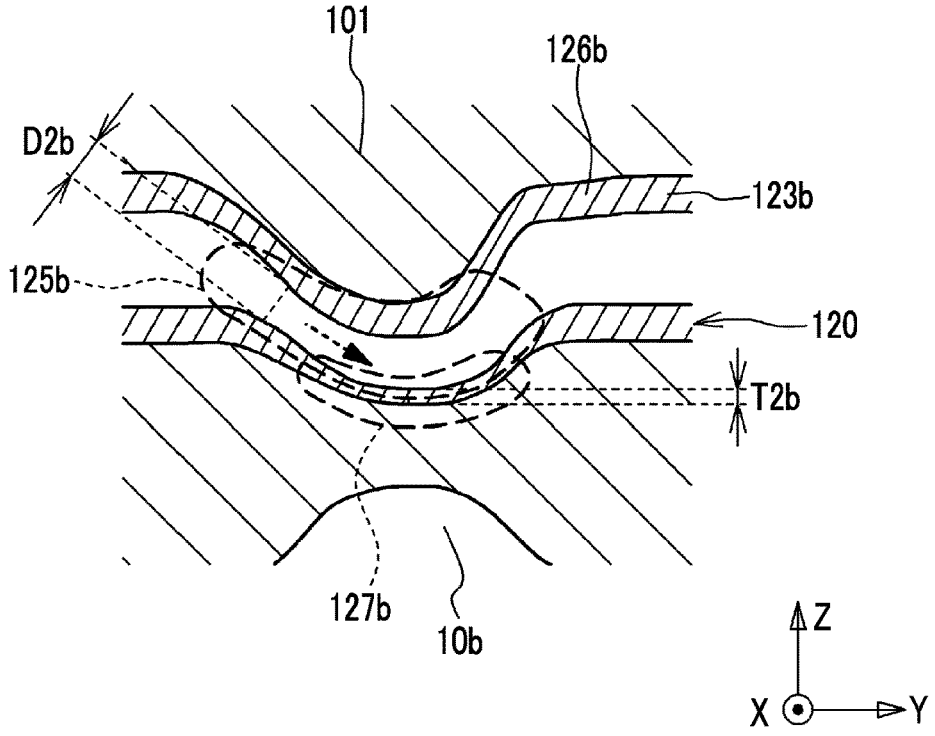
FIG. 5B is a sectional view illustrating the vicinity of a curved portion.
Figure 6A:
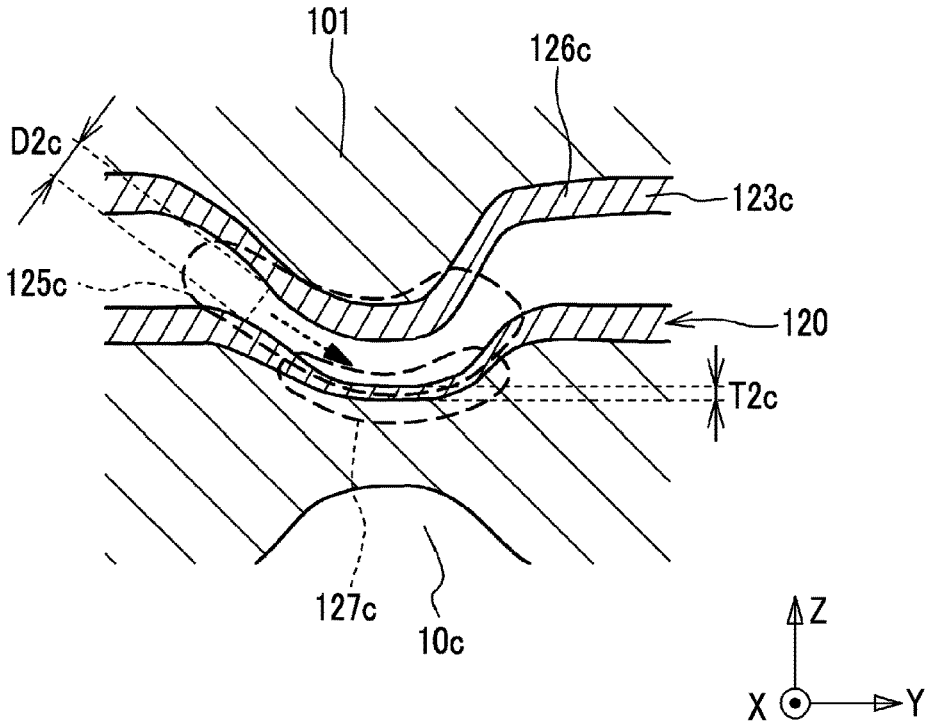
FIG. 6A is a sectional view illustrating the vicinity of a curved portion.
Figure 6B:
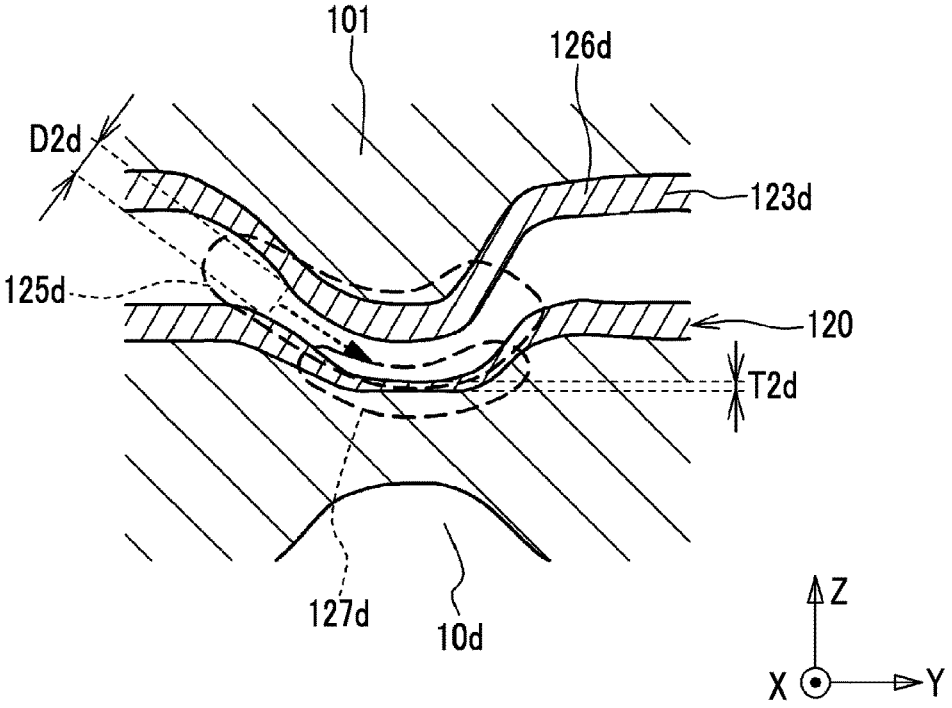
FIG. 6B is a sectional view illustrating the vicinity of a curved portion.

Similarly, as illustrated in FIGS. 5B, 6A, and 6B, the curved portions 123*b* to 123*d* are respectively provided with throttle regions 125*b* to 125*d*, thick portions 126*b* to 126*d*, and thin portions 127*b* to 127*d* and a temperature rise in the combustion chambers 10*b* to 10*d* is more effectively suppressed. The throttle regions 125*a* to 125*d* are respectively formed in the curved portions 123*a* to 123*d* and a decrease in flow rate of the refrigerant is suppressed. Accordingly, a decrease in flow rate of the refrigerant in the entire pipe member 120 is suppressed and a temperature rise in the combustion chambers 10*a* to 10*d* is more effectively suppressed. As illustrated in FIG. 2, the curved portions 123*a* to 123*d* are also curved in the horizontal direction. Therefore, the curved portions 123*a* to 123*d* are curved in the horizontal direction and are curved toward the vertically lower side.

As with the pipe member 110, the pipe member 120 is formed such that the respective diameters D2*a* to D2*d* of the throttle regions 125*a* to 125*d* descend in this order: the diameter D2*a*, the diameter D2*b*, the diameter D2*c*, and the diameter D2*d*. Therefore, the flow rates of the refrigerants flowing in the throttle regions 125*a* to 125*d* ascend in this order: the throttle region 125*a*, the throttle region 125*b*, the throttle region 125*c*, and the throttle region 125*d*. The thicknesses T2*a* to T2*d* of the thin portions 127*a* to 127*d* descend in this order: the thickness T2*a*, the thickness T2*b*, the thickness T2*c*, and the thickness T2*d*. Accordingly, the variation in temperature in the combustion chambers 10*a* to 10*d* is suppressed. Although the thin portions 127*a* to 127*d* are thin, a decrease in strength of the pipe member 120 is suppressed since the thick portions 126*a* to 126*d* are thick.

Next, a manufacturing process of the cylinder head 100 will be described. First, a core for forming the intake ports 20*a* to 20*d*, the exhaust ports 30*a* to 30*d*, and the exhaust manifold 31 and the pipe members 110, 120 are prepared. Next, the core and the pipe members 110, 120 are set in a cavity in a casting mold. Next, with a refrigerant such as air or water flowing into the pipe members 110, 120, the cavity is filled with molten metal at a pressure such that the molten metal does not flow into the pipe members 110, 120 and the core does not collapse. Thereafter, the molten metal is cooled and the molten metal is bonded to the pipe members 110, 120, and thus the cylinder head 100 is cast. After the cylinder head 100 is cast, the core is destroyed, discharged, and removed such that the cylinder head 100 in which the intake port 20*a* or the like is formed is manufactured.

As described above, the thin portion 117*a* is provided in the throttle region 115*a* and a decrease in flow rate of the refrigerant flowing along the thin portion 117*a* is suppressed even during the casting. Therefore, it is possible to efficiently cool the thin portion 117*a* and to suppress erosion of the thin portion 117*a* that occurs due to high-temperature molten metal. Similarly, it is possible to suppress erosion of the thin portions 117*b* to 117*d*.

The same applies to the pipe member 120. That is, the thin portion 127*a* is provided in the throttle region 125*a* and a decrease in flow rate of the refrigerant flowing along the thin portion 127*a* is suppressed even during the casting. Therefore, it is possible to efficiently cool the thin portion 127*a* and to suppress erosion of the thin portion 127*a* that occurs due to high-temperature molten metal. Similarly, it is possible to suppress erosion of the thin portions 127*b* to 127*d*.

For example, it is also conceivable to form a water jacket using a core. However, in a case of a complicated shape in which a plurality of curved portions is present as with the embodiment, there is a possibility that preparation is difficult. When a metal pipe member of which the shape can be easily processed in advance is used as in the embodiment, the degree of freedom in shape of the refrigerant flow path in the cylinder head 100 is secured.

Although the embodiment of the present invention has been described in detail above, the present invention is not limited to the specific embodiment described above, and various modifications and changes are possible within the scope of the gist of the present invention described in claims.

In the embodiment, a cylinder head for an inline four-cylinder engine has been described as an example. However, the invention is not limited to this. Any cylinder head with two or more linearly arranged combustion chambers may be used. A cylinder head for a diesel engine that does not include an ignition plug may also be used.

A configuration in which one of the pipe members 110, 120 is provided may also be adopted.

Any configuration may be adopted as long as at least one of the curved portions 113*a* to 113*d* is provided. The curved portion 113*a* is positioned at a position between the two exhaust ports 30*a* but a curved portion may be provided at a position other than the position between the two exhaust ports 30*a*. The same applies to the curved portions 123*a* to 123*d*.

The diameters D1*a* to D1*d* may be the same as each other. The diameters of a plurality of adjacent curved portions among the diameters D1*a* to D1*d* may be the same as each other and the diameter of a curved portion upstream of the adjacent curved portions may be greater than the diameters of the adjacent curved portions. Similarly, the diameters of the adjacent curved portions among the diameters D1*a* to D1*d* may be the same as each other and the diameter of a curved portion downstream of the adjacent curved portions may be smaller than the diameters of the adjacent curved portions. The thicknesses T1*a* to T1*d* may be the same as each other. The thicknesses of thin portions of the adjacent curved portions among the thicknesses T1*a* to T1*d* may be the same as each other and a thin portion of a curved portion upstream of the adjacent curved portions may be thicker than the adjacent curved portions. The thicknesses of thin portions of the adjacent curved portions among the thicknesses T1*a* to T1*d* may be the same as each other and a thin portion of a curved portion downstream of the adjacent curved portions may be thinner than the adjacent curved portions. The same applies to the diameters D2*a* to D2*d* and the thicknesses T2*a* to T2*d*.

The thin portions 117*a* to 117*d* may not be provided and the thicknesses of the wall portions of the curved portions 113*a* to 113*d* may be constant at all times. The thin portions

117*b* to 117*d* may be provided without the thin portion 117*a*. The thin portions 117*c*, 117*d* may be provided without the thin portions 117*a*, 117*b*. The thin portion 117*d* may be provided without the thin portions 117*a* to 117*c*. The same applies to the thin portions 127*a* to 127*d*.

At least one of the pipe members 110, 120 may be made of copper. For example, in a case where the pipe member 110 is made of copper and the cylinder head main body 101 is made of an aluminum alloy, since the melting point of copper is higher than the melting point of an aluminum alloy, it is possible to further prevent erosion of the thin portion 117*a* or the like.

What is claimed is:

1. A cylinder head for an internal combustion engine, the cylinder head comprising:

a cylinder head main body in which a plurality of combustion chambers is arranged; and a pipe member that extends along a direction in which the combustion chambers are arranged, through which a refrigerant flows, the pipe member being embedded in the cylinder head main body, wherein:

the pipe member is provided with a first curved portion that is curved, the first curved portion is provided with a first throttle region, a sectional area of the first throttle region being partially reduced, and the first curved portion includes with a first thin portion which faces a first combustion chamber of the plurality of combustion chambers, the first thin portion having a wall thickness that is thinner than a first opposite portion on an opposite of the first curved portion from the first thin portion.

2. The cylinder head according to claim 1, wherein the first combustion chamber is closest to the first curved portion and the first curved portion is curved to be close to the first combustion chamber.

3. The cylinder head according to claim 1, wherein at least a portion of the first thin portion is provided in the first throttle region.

4. The cylinder head according to claim 1, wherein:

the combustion chambers further include a second combustion chamber that is adjacent to the first combustion chamber and that is downstream or upstream of the first combustion chamber in a flowing direction of the refrigerant;

the pipe member is further provided with a second curved portion that is closest to the second combustion chambers;

a second wall portion of the second curved portion is provided with a second thin portion which has a wall thickness thinner than the first thin portion.

5. The cylinder head according to claim 1, wherein the pipe member is a first pipe member and the cylinder head includes a second pipe member disposed such that an ignition plug is interposed between the first pipe member and the second pipe member in a top view.

6. A cylinder head for an internal combustion engine, the cylinder head comprising:

a cylinder head main body in which a plurality of combustion chambers is arranged; and a pipe member that extends along a direction in which the combustion chambers are arranged, through which a refrigerant flows, the pipe member being embedded in the cylinder head main body, wherein:

the pipe member is provided with a first curved portion that is curved;

the first curved portion is provided with a first throttle region, a sectional area of the first throttle region being partially reduced;

the combustion chambers include a first combustion chamber which is closest to the first curved portion and the first curved portion is curved to be close to the first combustion chamber, the combustion chambers further include a second combustion chamber that is adjacent to the first combustion chamber and that is downstream or upstream of the first combustion chamber in a flowing direction of the refrigerant;

the pipe member is further provided with a second curved portion that is closest to the second combustion chamber;

the second curved portion is provided with a second throttle region; and a path sectional area at the second throttle region is smaller than a path sectional area at the first throttle region.

7. The cylinder head according to claim 6, wherein the first curved portion is positioned between two exhaust ports that communicate with the first combustion chamber, and the second curved portion is positioned between two exhaust ports that communicate with the second combustion chamber.

8. The cylinder head according to claim 6, wherein the first curved portion is positioned between two intake ports that communicate with the first combustion chamber, and the second curved portion is positioned between two intake ports that communicate with the second combustion chamber.

* * * * *